US012774538B2

(12) United States Patent
Gerharz

(10) Patent No.: US 12,774,538 B2
(45) Date of Patent: Oct. 27, 2026

(54) FILAMENT-MAKING APPARATUS

(71) Applicant: Stephan Gerharz, Troisdorf (DE)

(72) Inventor: Stephan Gerharz, Troisdorf (DE)

(73) Assignee: REIFENHAEUSER GMBH & CO KG MASCHINENFABRIK, Troisdorf (DE)

( * ) Notice: Subject to any disclaimer, the term of this patent is extended or adjusted under 35 U.S.C. 154(b) by 0 days.

(21) Appl. No.: 18/542,841

(22) Filed: Dec. 18, 2023

(65) Prior Publication Data

US 2024/0209547 A1 Jun. 27, 2024

(30) Foreign Application Priority Data

Dec. 21, 2022 (DE) ..... 102022134399.5
Dec. 21, 2022 (EP) ..... 22215646

(51) Int. Cl.
*D01D 4/02* (2006.01)
*D01D 1/10* (2006.01)
*D01D 4/06* (2006.01)

(52) U.S. Cl.
CPC ..... *D01D 4/02* (2013.01); *D01D 1/106* (2013.01); *D01D 4/06* (2013.01)

(58) Field of Classification Search
CPC ..... D01D 4/02; D01D 4/06; D01D 1/106
See application file for complete search history.

(56) References Cited

U.S. PATENT DOCUMENTS 3,439,382 A * 4/1969 Sluijters ..... D01D 4/06 425/463
3,460,199 A * 8/1969 Kiscaden ..... D01D 4/00 425/191
4,084,930 A * 4/1978 Neveu ..... D01D 5/22 425/198
5,162,074 A * 11/1992 Hills ..... D01D 4/06 264/211.14
5,635,222 A * 6/1997 Meidhof ..... B29C 48/2562 425/464
5,688,458 A * 11/1997 Koschinek ..... D01D 5/098 264/237
7,156,639 B2 * 1/2007 Baumeister ..... B29C 48/00 425/464
7,470,389 B2 * 12/2008 Berrigan ..... D01D 5/0985 156/181
9,033,692 B2 * 5/2015 Glawion ..... D01D 5/06 425/67

(Continued)

*Primary Examiner* — Seyed Masoud Malekzadeh
(74) *Attorney, Agent, or Firm* — Andrew Wilford

(57) ABSTRACT

An apparatus for making filaments has a spinneret plate having a row of holes from which emerge filaments. A manifold distributes a supplied plastic melt over a starting spinning width. A filter plate is downstream of the manifold. A pack of distributor plates is downstream of the filter plate. The distributor plates each have a plurality of distributor holes distributed over a manifold width. The distributor holes receive the plastic melt emerging from the filter plate. The spinneret plate is downstream of the distributor-plate pack and has a row of spinneret passages extending over a final spinning width aligned with the spinneret holes. An output face of the filter plate turned toward the distributor-plate pack and/or an inlet face of the spinneret plate turned toward the distributor-plate pack is curved or crowned at least in sections.

15 Claims, 5 Drawing Sheets

(56) References Cited

U.S. PATENT DOCUMENTS

| | | | | |
|---|---|---|---|---|
| 2003/0003834 | A1* | 1/2003 | Berrigan | D04H 3/02<br>156/166 |
| 2004/0265415 | A1* | 12/2004 | Baumeister | D01D 4/06<br>425/464 |
| 2005/0140067 | A1* | 6/2005 | Berrigan | D04H 3/16<br>264/518 |
| 2009/0152762 | A1* | 6/2009 | Rave | D04H 3/02<br>264/211.1 |
| 2014/0044820 | A1* | 2/2014 | Glawion | D01D 4/02<br>425/67 |
| 2023/0203728 | A1* | 6/2023 | Angelico | B29C 48/05<br>425/464 |

* cited by examiner

5
CD
2
MD
5
9
7a
a
9
7b
b
9
7c
c

FILAMENT-MAKING APPARATUS

FIELD OF THE INVENTION

The present invention relates to a filament-making apparatus. More particularly this invention concerns such an apparatus for continuous thermoplastic filaments for nonwoven.

BACKGROUND OF THE INVENTION

An apparatus for making filaments, in particular filaments of thermoplastic material, wherein the apparatus comprises at least one spinneret plate and wherein the filaments emerge from spinneret holes of this spinneret plate in at least one filament row. In particular, the invention relates to an apparatus for producing spunbonds or nonwoven webs of filaments of thermoplastic material. The filaments are preferably continuous filaments. Continuous filaments differ from short fibers as a result of their quasi-continuous length, short fibers having significantly shorter lengths of, for example, 1 mm to 60 mm. It lies within the scope of the invention that the filaments are deposited on a conveyor, preferably on a depositing foraminous belt. The width of a product deposited on such a conveyor depends in particular on the spinning width. Spinning width means in this case in particular the width of a filament row emerging from spinneret holes of the spinneret plate.

Apparatuses of the aforesaid type are fundamentally known from practice in various embodiments. It is frequently desired to variably adjust the nonwoven web width and therefore the spinning width of the Apparatuses. This is possible for example by segmented Apparatuses in which a plurality of manifolds arranged in a row over the spinning width is provided which are switched off or switched on as required. However, this configuration has the disadvantage that plastic residues can remain in the switched-off manifold segments which can lead to contaminations of the apparatus and ultimately to interruptions in the operation of the apparatus. In this context, EP 1 486 591 A1 describes an apparatus in which at least one manifold is provided for distributing a supplied plastic melt to a preliminary spinning width, wherein a distributor plate package of distributor plates is located downstream of the manifold, wherein the individual distributor plates each have a plurality of distributor spinneret holes distributed over a distribution width and wherein a spinneret plate is located downstream of the distributor plate package, which has spinneret passages with the associated spinneret holes distributed over a final spinning width. By means of the distributor plate package, a reduction or expansion of the preliminary spinning width to a final spinning width can be achieved. The exchangeability of the distributor plates and the spinneret plate allows a variable adjustment of the final spinning width. In this configuration, the plastic melts flow from the manifold through the distributor holes of the distributor plates to the spinneret plate.

These apparatuses in which distributor plates are used to reduce or expand the preliminary spinning width to the final spinning width have proved fundamentally successful for producing filaments and nonwoven webs. However, when these Apparatuses are used in spinning operation, different thermal expansions of the distributor plates of the distributor plate package are obtained as a result of temperature differences. These temperature differences result from the fact that the plastic melt cools to a certain extent on the flow path from the manifold to the spinneret plate so that in spinning operation in particular the upper distributor plates assigned to the manifold are hotter than the lower distributor plates assigned to the spinneret plates. As a result of these temperature differences and the resulting different thermal expansion of the distributor plates, it is possible that the distributor holes of the distributor plates shift so that the flow path of the plastic melt through the distributor plate package is disadvantageously influenced. For example, the different thermal expansions of the distributor plates can have the result that distributor holes of adjacent distributor plates arranged one above the other are no longer arranged or oriented in the actually intended manner with respect to one another and for example, are no longer aligned with one another. This can result in a non-uniform distribution of the plastic melt and ultimately to spinning errors such as drop formation and the like. Although the distributor plate package is usually screwed circumferentially at the edges, the different thermal expansions of the distributor plates in the known Apparatuses are observed nonetheless to a not inconsiderable extent and frequently have a disadvantageous influence on the spinning process. Furthermore, the described different thermal expansions of the distributor plates can also occur as a result of thermal cleaning processes of the apparatus. This is where the invention begins.

OBJECT OF THE INVENTION

In view of this, the invention is based on the technical problem of providing an apparatus of the type mentioned initially in which the previously described disadvantages can be effectively and reliably avoided and in which in particular disadvantageous influences on the spinning process resulting from a different thermal expansion of the distributor plates can be reduced or avoided.

SUMMARY OF THE INVENTION

In order to solve this technical problem the invention teaches an apparatus for making filaments, in particular filaments of thermoplastic material, wherein the apparatus comprises at least one spinneret plate, wherein the filaments emerge from spinneret holes of the spinneret plate in at least one filament row

- wherein at least one manifold is provided for distributing a supplied plastic melt to a preliminary spinning width, wherein at least one filter plate is located downstream of the manifold,
- wherein a distributor plate package of distributor plates is located downstream of the filter plate, wherein the individual distributor plates each have a plurality of distributor holes distributed over a distribution width, wherein the distributor holes are provided for receiving the plastic melt emerging from the filter plate,
- wherein the spinneret plate is located downstream of the distributor plate package, wherein the spinneret plate has spinneret passages with the associated spinneret holes distributed over a final spinning width. The apparatus according to the invention is characterized in that an outlet surface of the filter plate associated with the distributor plate package and/or an inlet surface of the spinneret plate associated with the distributor plate package is curved or crowned at least in sections.

The term final spinning width means within the scope of the invention in particular the total width of a row of filaments emerging from the apparatus and therefore the width of the row of associated spinneret holes. The term preliminary spinning width means within the scope of the invention in particular the width or spinning width of the end of the manifold on the filter plate side. Here and subsequently for directional information, instead of the terms preliminary spinning width and/or final spinning width, in particular the expression spinning width is simply also used. In particular, the extension or width of a row of distributor holes of a distributor plate within the scope of the invention also defines a distribution width associated with this distributor plate.

The expressions "arranged downstream", "arranged upstream", "above", "below", "above one another" and "below one another" within the scope of the invention relate in particular to the flow direction of the plastic melt from the manifold to the spinneret plate in the operating state of the apparatus.

According to a preferred embodiment of the invention, only one manifold is provided in the direction transverse to the machine direction (CD) or in relation to the spinning width, which expediently has only one spinning pump for the plastic melt arranged upstream thereof. If the apparatus is configured or set up according to a particularly preferred embodiment to produce multicomponent filaments, in particular bicomponent filaments, it is expedient if the apparatus has at least two adjacently arranged manifolds in the machine direction (MD). Then a separate pump for the respective plastic melt is preferably arranged upstream of these two manifolds. Additionally or alternatively however it also lies within the scope of the invention that two or more manifolds are arranged next to one another over the spinning width or transversely to the machine direction (CD) and in this case, a separate spinning pump can be arranged upstream of each manifold.

Machine direction (MD) or MD direction means within the scope of the invention in particular the conveying direction of a conveyor for the filaments or the nonwoven web and therefore the direction transverse to the preliminary or final spinning width. On the other hand, CD or CD direction means in particular the direction transverse to the machine direction or the direction along the spinning width. Expediently a plurality of filament rows are produced next to one another in each case over the final spinning width in the machine direction (MD) or transversely to the spinning width. For this purpose it is recommended that rows of spinneret holes arranged next to one another in the machine direction are provided. Preferably the spinneret holes of adjacent rows are arranged offset with respect to one another.

It lies within the scope of the invention that the at least one manifold is configured as a coat-hanger distributor. With such a coat-hanger distributor the plastic melt is initially fed through a narrow feed passage in relation to the spinning width and undergoes a gradual increase in width to the preliminary spinning width taking into account a uniform flow profile at the exit of the plastic melt from the coat-hanger distributor in particular by realizing the same counterpressure at each outlet point of the plastic melt.

According to the invention, at least one filter plate is located downstream of the manifold. The filter plate preferably has perforated passages for the plastic melt. The perforated passages expediently extend transversely, in particular perpendicular to the flat filter plate extension. It is recommended that the perforated passages of the filter plate are arranged in at least one row extending in the direction of the preliminary spinning width. In principle, within the scope of the invention however, the filter plate can have other configurations.

According to the invention, a distributor plate package of distributor plates is arranged downstream of the filter plate. "Distributor plate package" here means a package of at least two, preferably of at least three, preferably of at least four, quite particularly preferably of at least five, for example, of at least six distributor plates arranged one above the other. It is preferable if, apart from the distributor plates of the distributor plate package, the apparatus has no further distributor plates. Then the distributor plate package is arranged directly downstream of the filter plate and directly upstream of the spinneret plate. In principle however, at least one further distributor plate could be provided upstream and/or downstream of the distributor plate package.

The expression outlet surface of the filter plate means within the scope of the invention in particular the outlet surface of the filter plate assigned to the distributor plate package or the uppermost distributor plate. Outlet surface of the filter plate therefore expediently also means outlet side of the filter plate. According to a preferred embodiment, the outlet surface of the filter plate is in direct contact with the distributor plate package or with the uppermost distributor plate. The expression inlet surface of the spinneret plate means within the scope of the invention in particular the surface of the spinneret plate assigned to the distributor plate package or the last distributor plate. Inlet surface of the spinneret plate means in this respect expediently also the inlet side of the spinneret plate. The inlet surface of the spinneret plate according to a preferred embodiment is in direct contact with the distributor plate package or the lowest distributor plate.

According to the invention, the outlet surface of the filter plate assigned to the distributor plate package and/or the inlet surface of the spinneret plate assigned to the distributor plate package is curved or crowned at least in sections. It is preferred if at least the outlet surface of the filter plate, in particular the outlet surface of the filter plate is curved or crowned at least in sections. Curved or crowned means within the scope of the invention in particular curved or crowned toward the distributor plate package and therefore preferably convexly curved. Expediently, the outlet surface of the filter plate and/or the inlet surface of the spinneret plate is ground curved or crowned. The outlet surface of the filter plate and/or the inlet surface of the spinneret plate is therefore in particular not planar but rounded so that within the scope of the invention a convex configuration of the outlet surface of the filter plate and/or of the inlet surface of the spinneret plate oriented toward the distributor plate package is obtained. As a result, an additional bracing of the distributor plates of the distributor plate package is achieved so that disadvantageous influences on the spinning process due to the different thermal expansion of the distributor plates can be reliably counteracted. In addition, manufacturing tolerances, for example, the flatness of the individual components of the apparatus can be compensated.

It is very preferable that the outlet surface of the filter plate and/or the inlet surface of the spinneret plate is curved or crowned in relation to its extension in the machine direction (MD) at least in a middle section or central section. It is quite particularly preferred that the outlet surface of the filter plate and/or the inlet surface of the spinneret plate is curved or crowned over its entire extension or substantially over its entire extension in the machine direction (MD). Within the scope of the invention according to a preferred embodiment, the previously described curvature or crowning is therefore implemented over the entire extension or substantially over the entire extension of the outlet surface of the filter plate and/or the inlet surface of the spinneret plate in the machine direction (MD). The curved, in particular the convexly curved or crowned configuration of the filter plate and/or the spinneret plate therefore extends expediently with regard to the conveying direction or the machine direction (MD) from the inlet side to the outlet side of the filter plate and/or the spinneret plate. As a result, the distributor plates of the distributor plate package can be simply and reliably screwed in their outer regions to the filter plate and/or the spinneret plate, wherein an additional bracing of the distributor plate package between the filter plate and the spinneret plate is achieved in relation to the extension of the distributor plates in the machine direction (MD) at least in a central section or middle section. This will be explained in further detail hereinafter. This configuration furthermore has the advantage that in this central section or middle section an additional screw connection can be avoided which would otherwise counteract the implementation of a homogeneous spinning field.

According to a preferred embodiment of the invention, a plurality of screws is provided for the connection of the distributor plates of the distributor plate package and/or for the connection of the assembly of distributor plate package and spinneret plate and/or filter plate, which preferably penetrate this assembly and are arranged at least in the edge-side outer regions of the assembly extending in the CD direction and particularly preferably are arranged to run around the assembly at the edges. As a result of the curved or crowned configuration of the filter plate and/or the spinneret plate, the pressing force of these screws is shifted from the edge-side outer regions of the assembly, in particular from the edge-side outer regions of the assembly extending in the CD direction, along the machine direction (MD) into the middle of the assembly. In this case, a linear load is expediently obtained from point loads in the region of the screws. Due to the plurality of screws, the integral of the linear loads expediently forms a uniform surface pressure within the area bordered by the screws arranged preferably circumferentially at the edges, which in particular ensures that the surface pressure acts essentially uniformly on the assembly of distributor plate package and spinneret plate and/or filter plate. Due to the surface pressure the boundary surfaces of the individual planes between the distributor plates of the distributor plate package and/or between the distributor plate package and the filter plate are preferably pressed uniformly. In order to shift the surface pressure preferably also in the region between two adjacently arranged screws reliably along the machine direction (MD) into the middle of the assembly of distributor plate package and spinneret plate and/or filter plate, the distance between adjacent screws is preferably selected accordingly. This applies in particular depending on the width of the assembly or the spinneret plate in the machine direction (MD). The wider is the spinneret plate in the MD direction, for example, the smaller the screw spacing in the CD direction should preferably be. Preferably in this connection, the screw diameter and the flange thickness of the screws are selected accordingly and adapted to the surface pressure.

It has proved successful if the distance between two screws which are arranged adjacently in the edge-side outer regions of the assembly of distributor plate package and spinneret plate and/or filter plate extending in the CD direction is between 20 mm and 70 mm, preferably between 25 mm and 60 mm, particularly preferably between 30 mm and 55 mm. Distance between two adjacent screws here in particular means the center-point distance or the flange center-point distance of the screws. According to one embodiment the distance between two adjacently arranged screws is in each case identical or substantially identical along the entire extension in the CD direction. In principle however, the distance between respectively two adjacently arranged screws can also be partially different along the extension in the CD direction.

Expediently the previously described curved or crowned configuration of the filter plate and/or the spinneret plate in the machine direction (MD) is also achieved along the entire extension or substantially along the entire extension of the filter plate and/or the spinneret plate transversely to the machine direction (CD), i.e. in the direction of the spinning width. In this way, the additional bracing of the distributor plates achieved due to the curved or crowned configuration of the filter plate and/or the spinneret plate in the machine direction (MD) can be achieved along the entire extension of the apparatus transverse to the machine direction (CD) or along the entire spinning width.

It lies within the scope of the invention that the radius of curvature of the curved or crowned section of the outlet surface of the filter plate and/or the inlet surface of the spinneret plate is constant or substantially constant over the entire extension of the curved or crowned section. If, according to a preferred embodiment of the invention, the outlet surface of the filter plate and/or the inlet surface of the spinneret plate is curved or crowned over its entire extension or substantially over its entire extension in the machine direction (MD), the radius of curvature of this curved or crowned outlet surface of the filter plate and/or the inlet surface of the spinneret plate is constant or substantially constant over the entire extension in the machine direction (MD). It is particularly preferred that the radius of curvature of the curved or crowned section of the outlet surface of the filter plate and/or the inlet surface of the spinneret plate is 10,000 mm to 55,000 mm, preferably 12,000 mm to 45,000 mm, particularly preferably 14,000 mm to 40,000 mm, quite particularly preferably 16,000 mm to 36,000 mm, for example 17,000 mm to 19,000 mm. If the radius of curvature is constant, for a spinneret plate having an exemplary width of 240 mm in the machine direction (MD), the pressing force is expediently significantly higher than in the case of a spinneret plate having an exemplary width of 120 mm in the machine direction (MD).

It is preferred that the apparatus according to the invention has at least one form-fit element which penetrates the filter plate and/or the distributor plate package and/or the spinneret plate in the flow direction of the plastic melt, in particular penetrates completely through the distributor plate package. For this purpose the distributor plates expediently each have at least one corresponding form-fit opening which is assigned to the at least one form-fit element. Preferably at least two, particularly preferably at least three, quite particularly preferably a plurality of such form-fit elements and form-fit openings are provided for the apparatus according to the invention or for the distributor plate package. Expediently the at least one form-fit element is a register pin. This embodiment of the apparatus according to the invention with form-fit elements and form-fit openings is based on the finding that a different thermal expansion of the distributor plates is additionally counteracted by form fit so that in particular a combination of force fit-due to the curved or crowned configuration of the filter plate and/or the spinneret plate according to the invention- and form fit is achieved.

It has already been explained that the invention in particular relates to an apparatus for producing spunbonds of filaments of thermoplastic material. According to a preferred embodiment, the apparatus according to the invention is configured as a spunbond apparatus and then spunbond nonwovens or nonwoven webs are expediently produced with the apparatus according to the invention. Monocomponent filaments and/or mixed filaments and/or multicomponent filaments, in particular bicomponent filaments, can be produced as continuous filaments using the apparatus according to the invention. The expression mixed filament means within the scope of the invention in particular a filament which is configured as a mono-type filament with regard to its cross-sectional configuration but consists of a mixture of at least two plastics or plastic melts. It has proved successful if a cooler for cooling the produced filaments is provided downstream of the spinneret plate, which preferably has a cooling chamber through which the filaments or continuous filaments produced are passed for cooling. It is preferred that air supply compartments for the supply of cooling air are arranged on two opposite sides of the cooling chamber. According to a preferred embodiment, air supply compartments arranged one above the other, in particular two air supply compartments arranged one above the other, from which air at different temperature is preferably introduced into the cooling chamber, are provided on two opposite sides of the cooling chamber. It has additionally proved successful that a monomer extractor is provided between the spinneret plate and the cooler by means of which perturbing gases produced during the spinning process can be removed from the apparatus or the spunbond apparatus.

Expediently a stretcher for stretching the produced filaments is arranged downstream of the cooler in the filament flow direction. According to a particularly recommended embodiment of the apparatus according to the invention, the assembly comprising the cooler and the stretcher is configured as a closed assembly in which apart from the supply of cooling air in the cooler, no further air is supplied into the closed assembly.

It is additionally preferred that at least one diffuser is arranged between the stretcher and the conveyor, in particular the depositing foraminous belt. The continuous filaments emerging from the stretcher are passed through the diffuser and then deposited on the conveyor. According to one embodiment of the invention, two diffusers connected one after the other are provided. The conveyor is also preferably configured as a continuously circulating conveyor or as a continuously circulating depositing foraminous belt. It is quite particularly preferred that the conveyor, in particular the depositing foraminous belt, is air-permeable so that process air can be extracted from below through the conveyor.

A particularly preferred embodiment of the invention is characterized in that the at least one spinneret plate is configured as an exchangeable spinneret plate. Further preferably the distributor plates are also configured to be exchangeable. In this way, the desired final spinning width can be set by suitable selection and exchange of the distributor plates and the spinneret plate. In this connection, it lies within the scope of the invention that the distribution width formed by the distributor holes of at least one distributor plate, preferably of a plurality of distributor plates, preferably of each distributor plate of the distributor plate package, is in each case less than or greater than the preliminary spinning width so that with the aid of the distributor plate package the preliminary spinning width is reduced or expanded to the final spinning width and the final spinning width can be set preferably by replacing the distributor plates or the distributor plate package. Expediently the distributor holes of the distributor plates are arranged vertically or perpendicular to the distributor plate surface. It is further preferred that at least in a part of the distributor plates of the distributor plate package the distributor holes open into distributor passages which result in an expansion or reduction of the inlet-side distribution width. The extension or the width of a row of distributor holes defines the distribution width for the respective distributor plate.

It lies within the scope of the invention that the distribution widths formed by the distributor holes of the individual distributor plates decrease or increase from the filter plate to the spinneret plate so that the preliminary spinning width is reduced or expanded to the final spinning width in this way. It also lies within the scope of the invention that a distributor plate in each case has a plurality of adjacently arranged rows of distributor holes. In this case, each row of distributor holes expediently extends over the distribution width of the respective distributor plate. Preferably the distributor holes of two adjacently arranged rows of distributor holes in the conveying direction or machine direction (MD) are arranged offset with respect to one another.

A particularly preferred embodiment of the invention is characterized in that at least one of the distributor plates has at least one distributor passage extending over at least a part of the distribution width, which distributor passage interconnects at least a part of the distributor holes. It lies within the scope of the invention that the distributor passage interconnects the distributor holes arranged in a row in relation to the distribution width. Expediently the distributor passage extends over the entire distribution width of the distributor plate and thereby preferably connects all the distributor holes of this distributor plate arranged in a row. According to a very preferred embodiment of the invention, the distributor holes of each row are interconnected by a distributor passage. Preferably a distributor passage is arranged horizontally or perpendicular to the distributor holes. It has also proved successful that a distributor passage of a distributor plate directly adjoins an adjacent distributor plate. A distributor passage adjoining an adjacent distributor plate expediently connects at least a part of the distributor holes of the adjacent distributor plate arranged in a row and preferably all the distributor holes of this adjacent distributor plate arranged in a row.

The previously described configuration of a distributor plate with distributor holes and distributor passages is preferably implemented in at least one of the distributor plates of the distributor plate package and preferably in at least one part, particularly preferably in at least a large part, of the distributor plates of the distributor plate package. The distributor passages serve in particular to distribute the plastic melt in the direction of or along the distribution widths to expand or reduce the preliminary spinning width.

A further preferred embodiment of the invention is characterized in that at least one of the distributor plates of the distributor plate package, preferably a part of the distributor plates of the distributor plate package has no distributor passages. This preferably relates to at least one distributor plate of the distributor plate package assigned to the spinneret plate and therefore to at least one lower distributor plate of the distributor plate package, for example, to the last distributor plate of the distributor plate package assigned to the spinneret plate. Within the framework of such a configuration, the preliminary spinning width is reduced or expanded to the desired distribution width or final spinning width by a part of the distributor plates which are expediently provided with corresponding distributor passages, and the distributor plates arranged downstream in the flow direction of the plastic melts can—in particular without substantial further influencing of the final spinning width— be used to further influence the plastic melts, for example for combining at least two plastic melts to produce multicomponent filaments or to reduce the diameter of the distributor holes and the like. It has also proved successful that at least in a part of the distributor plates of the distributor plate package the distributor holes of adjacent distributor plates arranged one above the other are arranged offset with respect to one another in relation to the distribution width. This is in particular the case with the distributor plates of the distributor plate package having distributor passages.

Within the scope of the invention, the at least one plastic melt preferably flows through the flow paths formed by the distributor plates or by the distributor plate package of distributor holes and distributor passages and emerges above the spinneret plate, in particular directly above the spinneret plate, from the distributor holes or a distributor plate or the last distributor plate of the distributor plate package and into associated spinneret passages of the spinneret plate. It is preferred that the flow paths for the at least one plastic melt—in particular with regard to the flow path length and/or the cross-sectional geometry of the distributor passages or the distributor holes and/or with regard to the cross-sectional area of the distributor passages or the distributor holes—are configured with the proviso that at the outlet of the plastic melt from the distributor plate package or at the inlet into the spinneret passages of the spinneret plate the same or substantially the same counterpressure is present at each distributor hole and/or at each spinneret passage. The counterpressure is therefore preferably set by the configuration of the flow paths which are assigned to the individual spinneret passages and in particular to the filaments produced.

Within the scope of the invention, the filter plate according to the invention is preferably adapted to support a filter. The filter is expediently arranged between the at least one manifold and the filter plate and therefore downstream of the manifold in the flow direction of the plastic melt. Preferably a narrow-mesh filtering sieve is used as filter. It also lies within the scope of the invention that a plurality of heating zones for the manifold is provided over the width of the at least one manifold. These heating zones are expediently each heatable separately and for this purpose, a heater is preferably assigned to each heating zone, which can be set separately to a specific heating temperature. With the aid of the heating zones or heaters, the viscosity or flow rate of the plastic melt can be influenced in the apparatus according to the invention or in the manifold.

According to a preferred embodiment of the invention, the final spinning width is at least 1,600 mm, preferably at least 1,800 mm, preferably at least 2,000 mm. With final spinning widths of this order of magnitude, the curved or crowned configuration of the outlet surface of the filter plate and/or the inlet surface of the spinneret plate according to the invention has proved particularly successful. It lies within the scope of the invention that the ratio of the preliminary spinning width to the final spinning width ($B_v$:$B_e$) in the case of a reduction of the preliminary spinning width is 1.01 to 1.5, preferably 1.02 to 1.3, particularly preferably 1.05 to 1.15 and in the case of an expansion of the preliminary spinning width is 0.7 to 0.98, preferably 0.8 to 0.97, particularly preferably 0.85 to 0.95. Such a ratio of the preliminary spinning width to the final spinning width has proved particularly successful within the scope of the invention.

According to a quite particularly preferred embodiment of the invention, the apparatus is configured or set up for producing multicomponent filaments, in particular bicomponent filaments, and/or mixed filaments and wherein the apparatus preferably has for this purpose at least two manifolds arranged adjacent to one another in the machine direction (MD) for the distribution of at least two plastic melts. Due to the at least two manifolds, expediently two plastic melts are distributed separately from one another to a preliminary spinning width. It has proved successful if the two plastic melts are then guided separately from one another through perforated passages of a filter plate downstream of the at least two manifolds. It is then recommended that the perforated passages of the filter plate are arranged per plastic melt in at least one row extending in the direction of the preliminary spinning width and the rows of perforated passages assigned to the respective plastic melts are quite particularly preferably arranged next to one another in the machine direction (MD). If the apparatus is configured or set up according to a quite particularly preferred embodiment to produce bicomponent filaments, it is recommended that two manifolds are provided which are arranged next to one another in the machine direction (MD) and in particular are each configured as coat-hanger distributors. It lies within the scope of the invention that in an apparatus configured or set up to produce multicomponent filaments or bicomponent filaments, only a single filter plate, a single distributor plate package and a single spinneret plate is arranged downstream of the manifolds.

If the apparatus according to a preferred embodiment is configured or set up to produce multicomponent filaments or bicomponent filaments and/or mixed filaments, it is quite particularly preferred that the distributor plate package or the distributor plates is/are configured with the proviso that at least two plastic melts initially flow separately from one another through the distributor plate package and can then be combined above the spinneret plate, in particular directly above the spinneret plate, to produce multicomponent filaments or bicomponent filaments. Expediently for this purpose the two plastic melts initially flow through at least two separate flow paths formed by the distributor plates or by the distributor plate package from distributor holes and distributor passages and can be combined or are combined above the spinneret plate, in particular directly above the spinneret plate. In this context it lies within the scope of the invention that the two plastic melts are combined at least by the distributor plates arranged directly above the spinneret plate, in particular at least by the last distributor plate of the distributor plate package. With the apparatus according to the invention, for example, multicomponent filaments or bicomponent filaments having a core-sheath configuration, having a side-by-side configuration, having a segmented-pie configuration and having an island-in-the sea configuration and the like and/or mixed filaments can be produced within the scope of the invention. For this purpose, the distributor plates of the distributor plate package and in particular the lower distributor plates of the distributor plate package assigned to the spinneret plate are preferably configured accordingly.

According to a very preferred embodiment which has quite particular importance within the scope of the invention, the diameter of a part of the distributor holes of at least one distributor plate of the distributor plate package—preferably of at least the last distributor plate of the distributor plate package arranged directly above the spinneret plate—differs from the diameter of the remaining distributor holes of this distributor plate. Within the scope of this embodiment, not all the distributor holes of at least one distributor plate of the distributor plate package have the same diameter but the diameter of a part of the distributor holes of the distributor plate differ from the diameter of the remaining distributor holes of this distributor plate. In this way, disadvantageous influences on the spinning process as a result of a different thermal expansion of the distributor plates can be additionally counteracted. In particular, in combination with the curved or crowned configuration of the filter plate and/or the spinneret plate according to the invention, the spinning stability of the apparatus can in this way be ensured particularly effectively and reliably. It is possible that the previously explained configuration of a distributor plate with different diameters of the distributor holes is implemented with at least two, in particular with at least three distributor plates of the distributor plate package and expediently these distributor plates are then assigned to the spinneret plate and in particular arranged above the spinneret plate one above the other. Within the scope of the invention, the distributor holes of a distributor plate are round, in particular circular, at least in a part of the distributor plates. It also lies within the scope of the invention that the distributor holes are angular, in particular rectangular, at least in a part of the distributor plates. The distributor plates together with the distributor passages preferably form flow paths for the plastic melt through the distributor plate package, wherein particularly preferably each spinneret passage or each spinneret hole of the spinneret plate and therefore in particular each filament produced is assigned a flow path of distributor holes and distributor passages.

It is possible within the scope of the invention that an increased counterpressure is implemented at specific openings for the plastic melt, for example, at specific distributor holes of a distributor plate, in particular the last distributor plate of the distributor plate package in order to spin thinner filaments in these regions. As a result, possibly system-dependent differences in the cooling air can be compensated. Quite particularly preferably the diameter $d_1$ of the distributor holes in at least one edge-side outer region, preferably in at least one CD outer region, of at least one distributor plate of the distributor plate package—preferably of at least the last distributor plate of the distributor plate package arranged directly above the spinneret plate—differs from the diameter $d_2$ of the distributor holes in the center of this distributor plate. Quite particularly preferably the diameter $d_1$ is greater than the diameter $d_2$. Preferably the diameter $d_1$ of the distributor holes in at least one, preferably in the two CD outer regions of at least one distributor plate differs from the diameter $d_2$ in the center of this distributor plate. Preferably it then holds that $d_1>d_2$. CD outer region means in this case in particular an outer region of a distributor plate extending parallel to the CD direction. Center of the distributor plate on the other hand means in particular a centrally arranged section of the distributor plate in relation to the flat extension of the distributor plate. This diameter distribution of the distributor holes of at least one distributor plate of the distributor plate package has proved particularly successful. In principle, it is also possible that the diameter $d_1$ is less than the diameter $d_2$.

It is further preferred if a diameter gradient of the distributor holes is obtained starting from at least one edge-side outer region, in particular from at least one, preferably from the two outer regions of the relevant distributor plate towards the center of the distributor plate.

It is additionally or alternatively possible that the diameter $d_1$ of the distributor holes in at least one, preferably in the two MD outer regions of at least one distributor plate differs from the diameter $d_2$ in the center of this distributor plate. Preferably it then holds that $d_1>d_2$. The invention thus also comprises an embodiment in which the diameter $d_1$ of the distributor holes of at least one distributor plate circumferentially at the edges differs from the diameter $d_2$ of the distributor holes in the center of this distributor plate, wherein it preferably holds that $d_1>d_2$.

According to a very preferred embodiment of the invention, the at least one manifold is formed on the basis of at least one material having a thermal conductivity at 20° C. of 30 to 42 W/(mK), preferably of 33 to 39 W/(mK), preferably of 34 to 38 W/(mK). The coefficients of thermal expansion of the distributor plates are preferably matched to the coefficients of thermal expansion of the manifold and/or the filter plate and/or the spinneret plate. The greater the final spinning width or the extension of the spinneret plate in the CD direction, the smaller are expediently the differences of the coefficients of thermal expansion of the distributor plates on the one hand and of the manifold and/or the filter plate and/or the spinneret plate on the other hand. Expediently the at least one manifold is formed on the basis of at least one hot-work tool steel and is preferably formed on the basis of 55NiCrMoV7 steel.

It lies within the scope of the invention that the filter plate and/or the spinneret plate is formed on the basis of at least one material having a thermal conductivity at 20° C. of 15 to 35 W/(mK), preferably of 18 to 32 W/(mK), preferably of 20 to 30 W/(mK), particularly preferably of 22 to 28 W/(mK). Further preferably the filter plate and/or the spinneret plate is formed on the basis of at least one martensitic steel, preferably on the basis of X17CrNi16-2 steel.

The previously described selection of material of the at least one manifold and/or the filter plate and/or the spinneret plate is based on the finding that the apparatus with such a configuration of these apparatus components withstands a cleaning process necessary after a certain operating time, in particular a thermal cleaning process, without substantial impairments. This is particularly important in view of the special adjustment of the individual apparatus components with a view to the flow path of the plastic melt or the plastic melts. As a result of the described preferred choice of material of the apparatus components, even after the cleaning process the functional reliability can still be ensured in particular with regard to the orientation of the holes and passages provided for the guidance of the plastic melt. This is particularly relevant in view of the curved or crowned configuration of the filter plate and/or spinneret plate according to the invention.

The invention is based on the finding that with the apparatus according to the invention, disadvantageous influences on the spinning process as a result of the different thermal expansion of the distributor plates can be effectively and reliably counteracted by the curved or crowned configuration of the outlet surface of the filter plate and/or the inlet surface of the spinneret plate. As a result of the configuration of the filter plate and/or the spinneret plate according to the invention and in particular of the assembly of the filter plate, the distributor plate package or the distributor plates and the spinneret plate, an additional bracing of the distributor plates is achieved so that disadvantageous effects of the different thermal expansion of the individual distributor plates are reduced or avoided in particular due to force fit. In particular, a disadvantageous influencing or orientation of the distributor holes and/or distributor passages of the distributor plates with respect to one another is prevented by the additional bracing. If, according to a preferred embodiment, additional form-fit elements or register pins are used for the distributor plate package, a particularly advantageous combination of force fit and form-fit is obtained. Nonetheless, a very simple and reliable adjustment of various final spinning widths can be achieved with the apparatus according to the invention. Thus, on the one hand the flexible usability of the apparatus and nevertheless the spinning stability and therefore the product quality of the product produced and the nonwoven web produced is ensured by the apparatus according to the invention. It must also be stressed that the previously described advantages are achieved with inexpensive measures and in this respect the apparatus is also characterized by a very advantageous economic viability.

BRIEF DESCRIPTION OF THE DRAWING

The invention will be described in detail hereinafter with reference to a drawing showing merely one embodiment. In the drawing in schematic view.

SPECIFIC DESCRIPTION OF THE INVENTION

Figure 1:
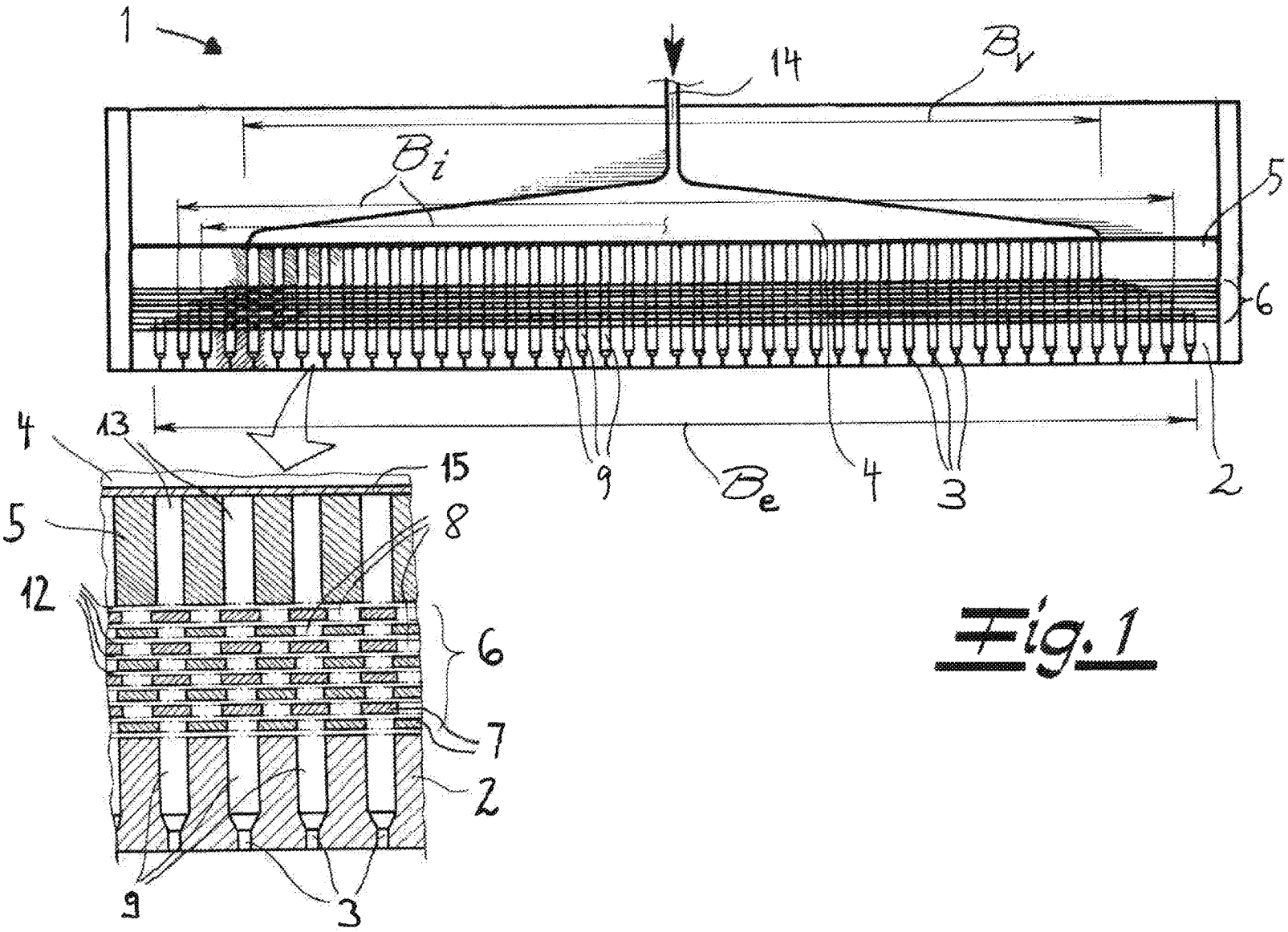
FIG. 1 shows a sectional view through an apparatus according to the invention in a first operating state.
Figure 2:
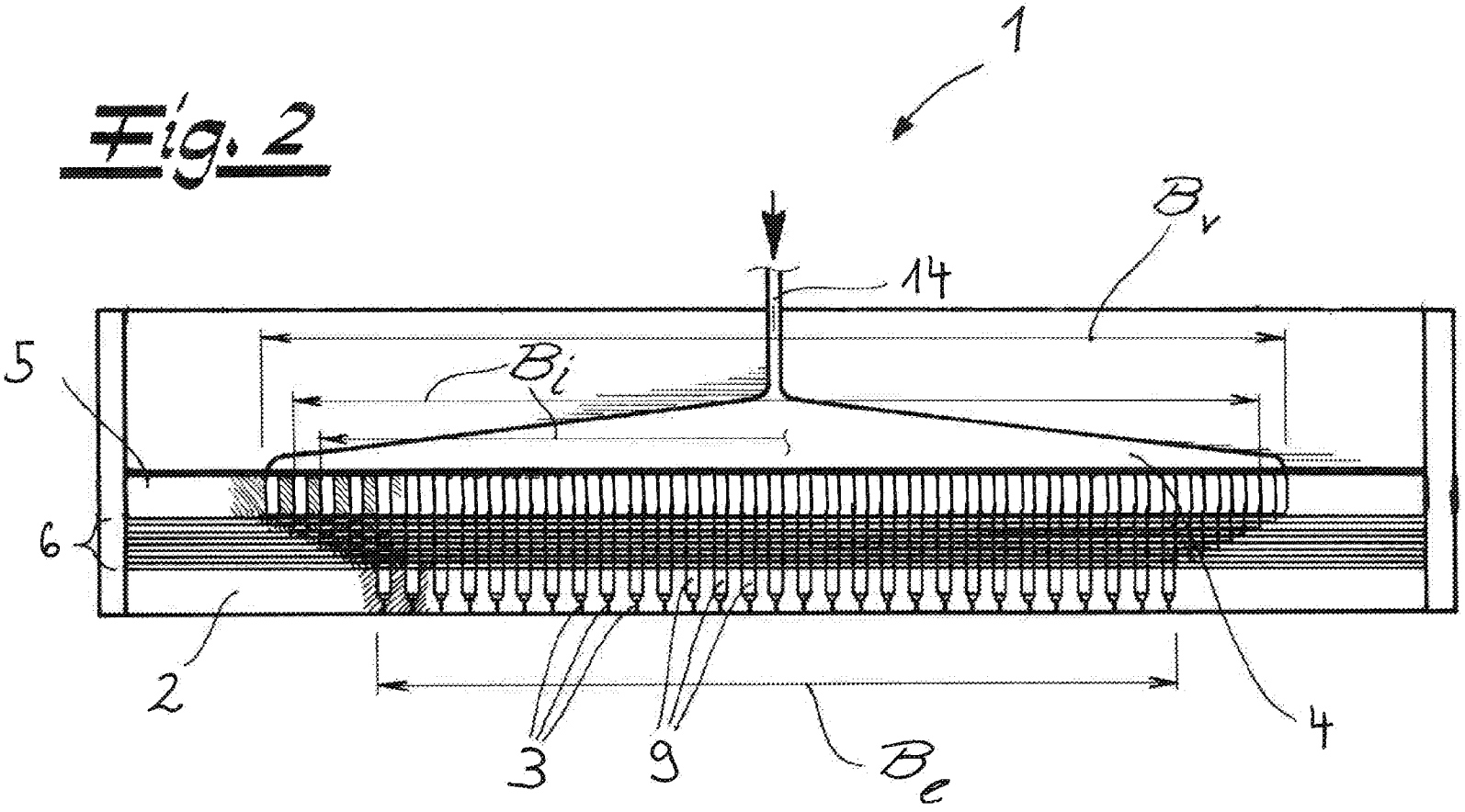
FIG. 2 shows the subject matter according to FIG. 1 in a second operating state.

The drawings show an apparatus 1 for producing filaments of thermoplastic material not shown in detail. The filaments are in particular continuous filaments. In the embodiment according to the drawing the filaments emerge in several rows extending over a final spinning width $B_e$ from the spinneret holes 3 of a spinneret plate 2. The plastic melt for the filaments to be spun is initially supplied from an extruder not shown in detail via a spinning pump also not shown in detail to a feed passage 14. This feed passage 14 opens into a manifold 4 which in the embodiment according to FIGS. 1 and 2 is configured as a coat-hanger distributor. By means of the manifold 4 the supplied plastic melt is distributed to a preliminary spinning width By. According to the invention and in this embodiment a filter plate 5 is arranged downstream of the manifold 4 which preferably and in this embodiment has perforated passages 13 for the plastic melt distributed over the preliminary spinning width $B_v$. It is recommend that and in this embodiment the filter plate 5 is used to support a filter 15. This can be seen in particular in FIG. 1. Expediently the filter 15 is located downstream of the manifold 4 in the flow direction of the plastic melt.

Again according to the invention and in this embodiment a distributor plate package 6 of distributor plates 7 is located downstream of the filter plate 5. Preferably and in this embodiment the distributor plate package 6 comprises a plurality of distributor plates 7. The distributor plates 7 each have a plurality of distributor holes 8 distributed over a distribution width $B_i$, wherein the distributor holes 8 are provided for receiving the plastic melt emerging from the filter plate 5. In FIGS. 1 and 2 a row of distributor holes 8 can be seen for each distributor plate 7.

The extension or the width of a row of distributor holes 8 defines the distribution width $B_i$ for each distributor plate 7. Preferably and in this embodiment each distributor plate 7 of the distributor plate package 6 has a plurality of adjacently arranged rows of distributor holes 8 in the direction transverse to the distribution width $B_i$. This can be seen for example in FIGS. 3*a* and 3*b*.

Figure 3B:
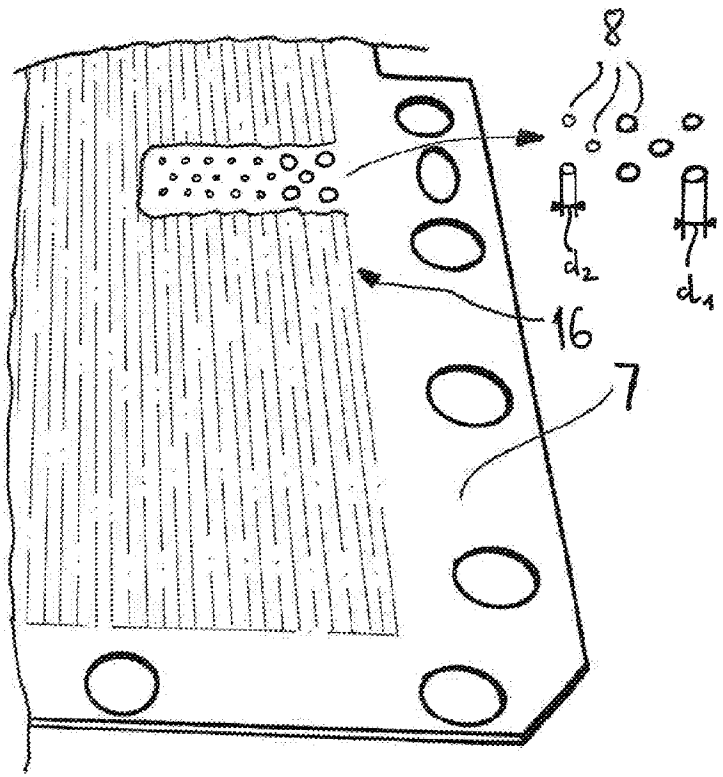
FIG. 3*b* shows a distributor plate according to the invention in a second embodiment.
Figure 3A:
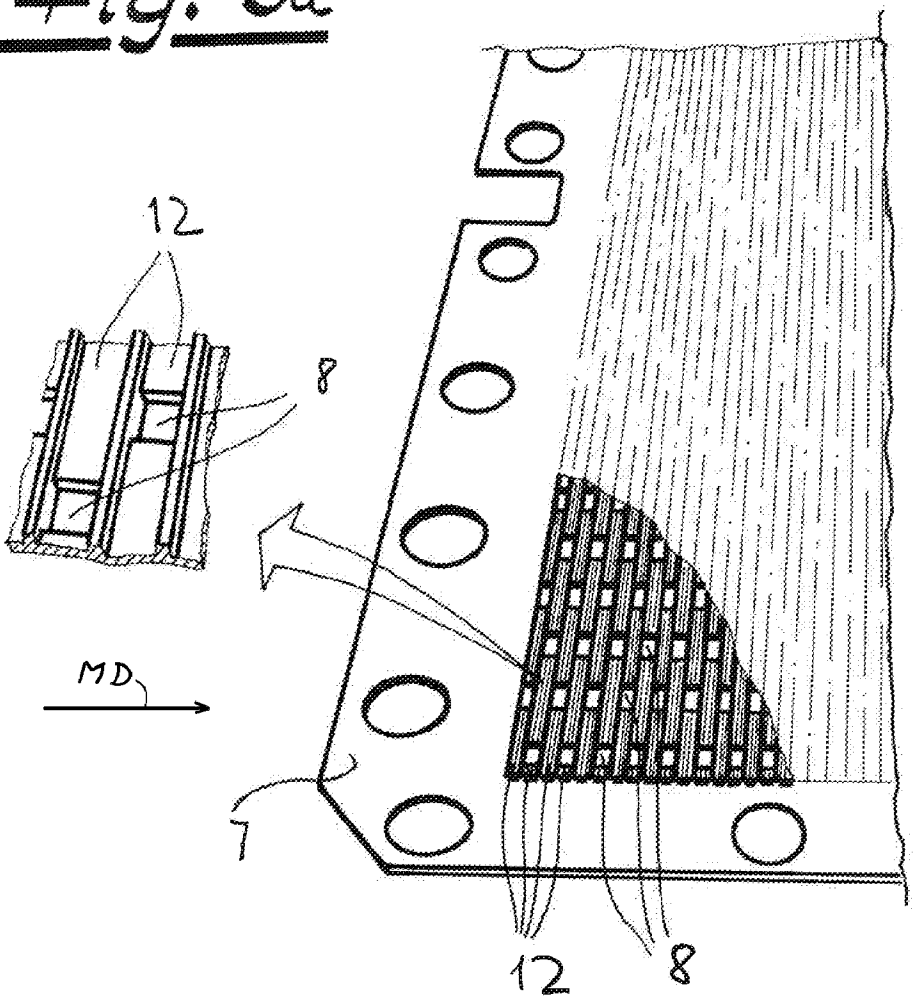
FIG. 3*a* shows a distributor plate according to the invention in a first embodiment.

In FIG. 3*a* it can additionally be seen that the distributor holes 8 according to a preferred embodiment are rectangular in cross-section. According to a further preferred embodiment of a distributor plate 7, the distributor holes 8 have a round, in particular circular cross-section. This is shown in FIG. 3*b*. In particular, the distributor holes 8 of distributor plates 7 which are arranged in the lower part f the distributor plate package 6 have a round or circular cross-section according to a preferred embodiment. Expediently and in the embodiment according to FIG. 3*a*, the distributor holes 8 of a distributor plate 7 each have the same diameter or substantially the same diameter.

Within the scope of a further preferred embodiment of the distributor plate 7, it is preferred that the diameter of a part of the distributor holes 8 of at least one distributor plate 7 of the distributor plate package 6 differs from the diameter of the remaining distributor holes 8 of this distributor plate 7. This is shown in FIG. 3*b*. According to one embodiment, this can be the last distributor plate 7 of the distributor plate package 6 arranged above the spinneret plate 2. Expediently and in the embodiment according to FIG. 3*b*, the distributor holes 8 are then round, in particular circular and the diameter of the distributor holes then means in particular the diameter of the circular distributor holes.

It can also be seen in FIG. 3*b* that particularly preferably the diameter $d_1$ of the distributor holes 8 in at least one, preferably in the two CD outer regions 16 of the distributor plate 7 differs from the diameter $d_2$ of the distributor holes 8 in the center of this distributor plate 7 and that preferably and in this embodiment the diameter $d_1$ is greater than the diameter $d_2$. The outer region 16 of the distributor plate 7 means in this case in particular an outer region of the distributor plate 7 extending parallel to the CD direction, i.e. along the distribution width or spinning width.

Figure 4:
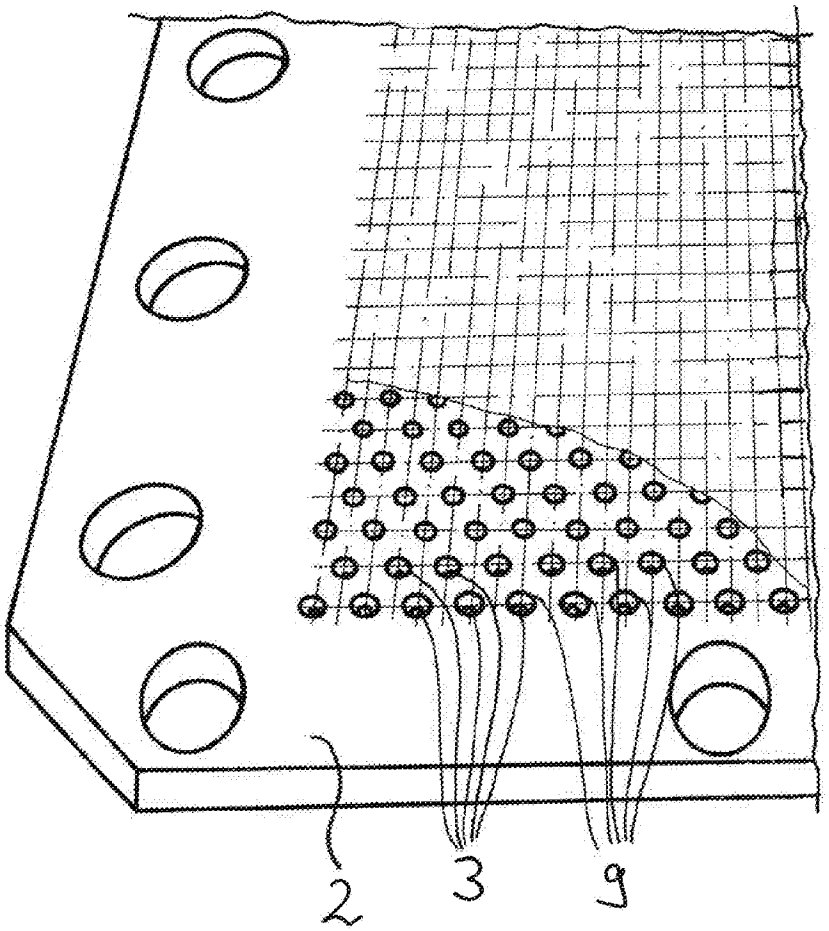
FIG. 4 shows a spinneret plate according to the invention.
Figure 6:
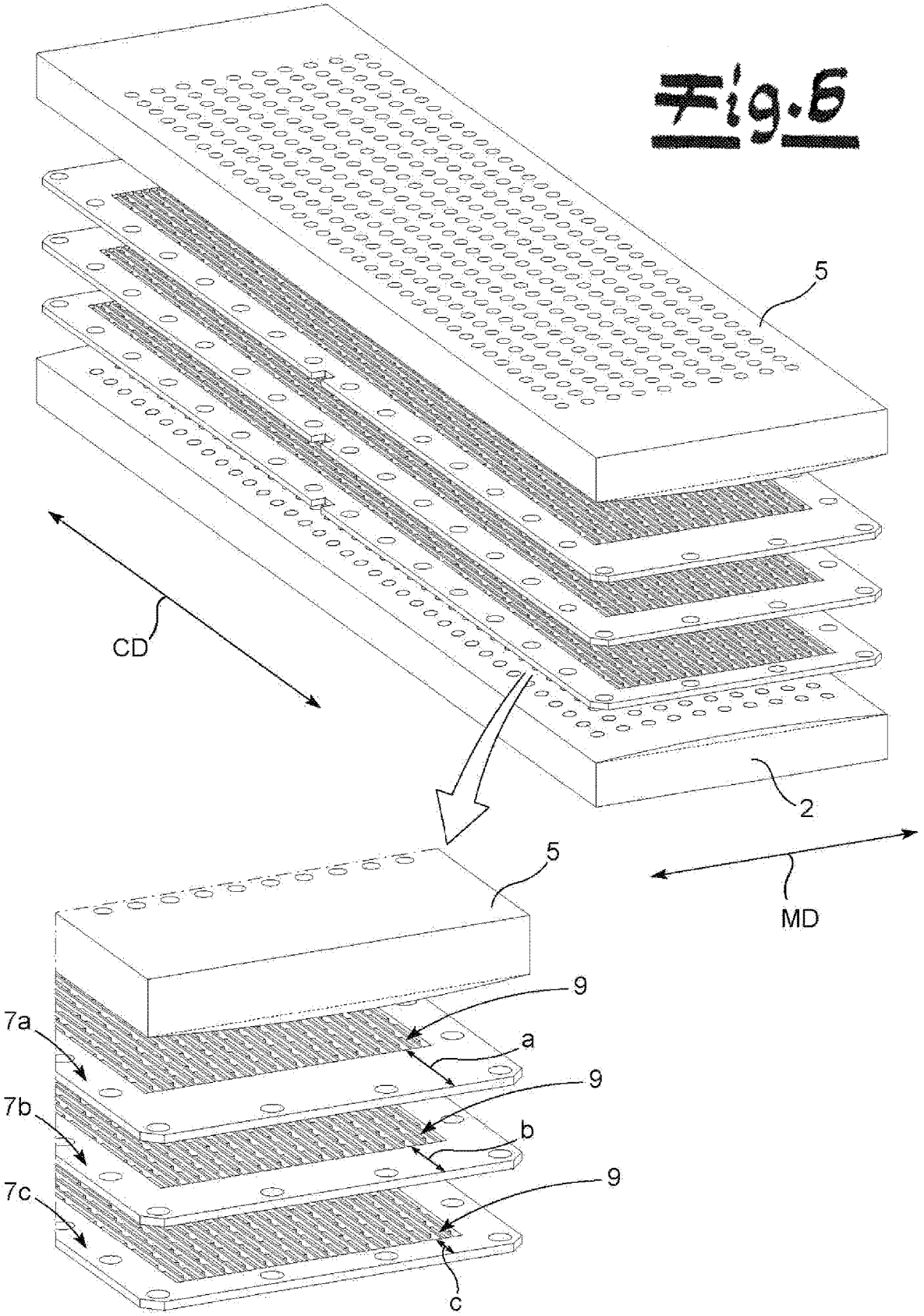

It can be seen in FIGS. 1 and 2 that the distributor holes 8 of the rows arranged one above the other of adjacent distributor plates 7 arranged one above the other are arranged offset with respect to one another in relation to the distribution width $B_i$. In the embodiment according to FIGS. 1, 2 and 3 it can be seen in this context that the distributor plates 7 of the distributor plate package 6 preferably have distributor passages 12 preferably extending over the spinning width $B_i$ wherein each distributor passage 12 interconnects the distributor holes 8 of one row. According to a preferred embodiment and in the embodiment according to FIGS. 1 and 2, at least in the majority of the distributor plates 7, a distributor passage 12 directly adjoins an adjacent distributor plate 7. In other words, this neighboring distributor plate 7 forms a wall of the adjacent distributor passage 12. Expediently and in this embodiment this distributor passage 12 connects distributor holes 8 of the neighboring distributor plate 7 arranged in a row. As a result, in the preferred embodiment according to FIGS. 1 and 2, it is achieved that the distributor holes 8 and the distributor passages 12 of the distributor plates 7 are connected to one another. Located downstream of the distributor plate package 6 or the distributor plates 7 is an exchangeable spinneret plate 2 which has spinneret passages 9 with the associated spinneret holes 3 distributed over the final spinning width $B_e$. FIG. 4 shows a spinneret plate 2 with spinneret passages 9 or spinneret holes 3. A plurality of rows of spinneret passages 9 or spinneret holes 3 are arranged next to one another transversely to the final spinning width $B_e$, in particular in a machine direction MD (FIG. 3*a*). Within the scope of the invention the distributor holes 8 together with the distributor passages 12 preferably form flow paths for the plastic melt through the distributor plate package 6. Expediently each spinneret passage 9 or each spinneret hole 3 of the spinneret plate 2 and therefore in particular each filament produced is assigned a flow path of distributor holes 8 and distributor passages 12.

Figure 5:
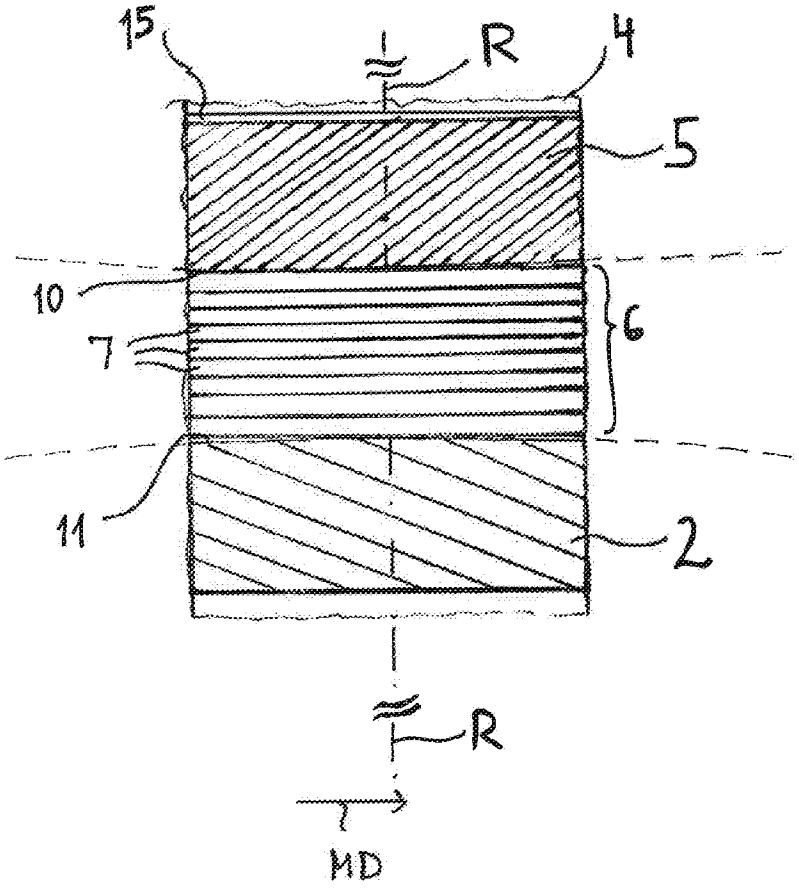
FIG. 5 shows a sectional view through the assembly of filter plate, distributor plate package and spinneret plate.

Expediently and as shown by the curved dashed lines in FIG. 5, an outlet surface 10 of the filter plate 5 assigned to the distributor plate package 6 and an inlet surface 11 of the spinneret plate 2 assigned to the distributor plate package 6 is curved or crowned over its entire or substantially over its entire extension in the machine direction MD. This can be seen in particular in FIG. 5. In FIG. 5 the perforated passages of the filter plate 5, the distributor holes and the distributor passages of the distributor plates 7 and the spinneret passages and spinneret holes of the spinneret plate 2 are not shown in detail. Preferably and in the embodiment according to FIG. 5, the outlet surface 10 of the filter plate 5 and the inlet surface 11 of the spinneret plate 2 are ground curved or crowned. Thus, the outlet surface 10 and the inlet surface 11 are not planar but rounded or rounded in toward the distributor plate package 6. Expediently and in this embodiment a convex curvature or crowning of the outlet surface 10 of the filter plate 5 and of the inlet surface 11 of the spinneret plate 2 oriented in the direction of the distributor plate package 6 is obtained. As a result, an additional bracing of the distributor plates 7 of the distributor plate package 6 is achieved in particular in a central section or middle section in relation to the machine direction MD. Machine direction MD means within the scope of the invention in particular the conveying direction of a conveyor for the filaments or the nonwoven web produced therefrom and therefore the direction transverse to the spinning width or distribution width. Within the scope of the invention and in this embodiment the curvature or crowning of the filter plate 5 or the spinneret plate 2 is therefore achieved over the entire extension of the outlet surface 10 of the filter plate and the inlet surface 11 of the filter plate in the machine direction MD. Quite particularly preferably and in this embodiment the radius of curvature R (see FIG. 5) of the curved or crowned outlet surface 10 of the filter plate 5 and the inlet surface 11 of the spinneret plate 2 is constant or substantially constant over the entire extension in the machine direction MD. In the embodiment according to the drawing, the radius of curvature R may be 17,000 mm to 19,000 mm.

In the operating state of the apparatus 1 according to FIG. 1 a distributor plate package 6 comprising a plurality of exchangeable distributor plates 7 is located downstream of the manifold 4 or the filter plate 5. The distribution widths $B_i$ formed by the distributor holes 8 of the individual distributor plates 7 expediently and in the embodiment according to FIG. 1 increase from the filter plate 5 to the spinneret plate 2. In this way the preliminary spinning width $B_v$ is expanded or increased to the final spinning width $B_e$. The distribution width B; therefore increases from distributor plate 7 to distributor plate 7 to the spinneret plate 2. In the operating state of the apparatus according to FIG. 2, a distributor plate package 6 comprising a plurality of exchangeable distributor plates 7 is also located downstream of the manifold 4 or the filter plate 5. Expediently and in the embodiment according to FIG. 2, the distribution widths B; formed by the distributor holes 8 of the individual distributor plates 7 decrease from the filter plate 5 to the spinneret plate 2. The preliminary spinning width $B_v$ is reduced in this way to the final spinning width $B_e$. The distribution width B; therefore decreases here from distributor plate 7 to distributor plate 7 to spinneret plate 2. It is also possible within the scope of the invention that not all distributor plates 7 of the distributor plate package 6 have distributor passages 12. According to an embodiment not shown in detail in the drawing, it is possible that the lower distributor plates 7 of the distributor plate package 6 which are assigned to the spinneret plate 2 have no distributor passages 12 and that the final distribution width $B_e$ is already achieved above this distributor plate 7.

According to a preferred embodiment of the invention, the final spinning width $B_e$ is at least 1,600 mm, preferably at least 1,800 mm. In the embodiment according to the drawing, the final spinning width may be at least 2,000 mm, for example. It has proved successful that the ratio of the preliminary spinning width By to the final spinning width $B_e$ ($B_v$:$B_e$) in the case of a reduction of the preliminary spinning width is 1.02 to 1.3 and in the case of an expansion of the preliminary spinning width $B_v$ is 0.8 to 0.97. In the embodiment according to FIG. 1 in which the preliminary spinning width By is expanded, the ratio $B_v$:$B_e$ may be between 0.85 and 0.95. In the embodiment according to FIG. 2 in which the preliminary spinning width By is reduced, the ratio $B_v$:$B_e$ may be 1.05 to 1.15.

The invention claimed is:

1. An apparatus for making thermoplastic filaments, the apparatus comprising a spinneret plate having an output face formed with a row of holes from which the filaments emerge in a filament-travel direction;

a manifold for distributing a supplied plastic melt over a starting spinning width;

a filter plate downstream of the manifold and having an inlet face confronting the output face, wherein the output face of the filter plate and/or the inlet face of the spinneret plate being curved or crowned over its entire or substantially its entire extension in a machine direction;

a pack of distributor plates between the inlet face and the output face and formed of distributor plates downstream of the filter plate, the distributor plates each having a plurality of distributor holes distributed over a manifold width $B_i$, the distributor holes receiving the plastic melt emerging from the filter plate, the spinneret plate being downstream of the pack of distributor plates and having a row of spinneret passages extending over a final spinning width and aligned with the holes of the spinneret plate; and a conveyor downstream in the filament-travel direction from the pack of distributor plates for receiving the filaments therefrom and transporting them in the machine direction transverse to the row of spinneret passages.

2. The apparatus according to claim 1, wherein a radius of curvature R of the curved or crowned section of the output face of the filter plate and/or the inlet face of the spinneret plate is constant or substantially constant over an entire extent of the curved or crowned section and measures 10,000 mm to 55,000 mm.

3. The apparatus according to claim 1, wherein the manifold width formed by the row of distributor holes of each distributor plate is smaller or larger than the starting spinning width, so that the starting spinning width is decreased or increased to the final spinning width by the distributor-plate pack, whereby exchanging the distributor plates of the distributor-plate pack changes the final spinning width.

4. The apparatus according to claim 1, wherein the manifold width formed by the rows of distributor holes of the individual distributor plates decreases or increases from the filter plate toward the spinneret plate, so that the starting spinning width is thereby decreased or increased to the final spinning width.

5. The apparatus according to claim 1, wherein at least one of the distributor plates has a distributor passage extending along at least a part of the distributor width, the distributor passage connecting at least some of the distributor holes to one another with the distributor holes of at least some of the distributor plates of the distributor-plate pack being offset relative to the distributor holes of adjacent distributor plates along the manifold width.

6. The apparatus according to claim 1, wherein the final spinning width is at least 1,600 mm.

7. The apparatus according to claim 1, wherein the ratio of the starting spinning width to the final spinning width is 1.01 to 1.5 on a reduction in the starting spinning width and is 0.7 to 0.98 on an increase in the starting spinning width.

8. The apparatus according to claim 1, wherein the apparatus makes multicomponent filaments and/or mixed filaments, and the apparatus has at least two such manifolds arranged next to one another in the machine direction for distributing at least two plastic melts.

9. The apparatus according to claim 8, wherein the distributor plates are provided such that at least two plastic melts initially flow separately from one another through the distributor-plate pack and can then be brought together directly above the spinneret plate to produce multicomponent filaments or bicomponent filaments.

10. The apparatus according to claim 1, wherein diameters of some of the distributor holes of at least one of distributor plates of the distributor-plate pack differs from diameters of other distributor holes of the one distributor plate.

11. The apparatus according to claim 1, wherein diameters $d_1$ of the distributor holes in at least one lateral region of at least one of the distributor plates of the distributor-plate pack differ from diameters $d_2$ of distributor holes in the center of this one distributor plate, and the diameters $d_1$ are greater than the diameters $d_2$.

12. The apparatus according to claim 1, wherein the manifold is designed of at least one material with a thermal conductivity at 20° C. of 30 to 42 W/mk.

13. The apparatus according to claim 1, wherein the manifold is formed of at least one hot-worked tool steel.

14. The apparatus according to claim 1, wherein the filter plate and/or the spinneret plate is formed of at least one material with a thermal conductivity at 20° C. of 15 to 35 W/mk.

15. The apparatus according to claim 1, wherein the filter plate and/or the spinneret plate are formed of a martensitic X17CrNi16-2 steel.

* * * * *